US008259291B2

(12) United States Patent
Taylor et al.

(10) Patent No.: US 8,259,291 B2
(45) Date of Patent: Sep. 4, 2012

(54) MULTI-BAND SEEKER WITH TILTABLE OPTICAL/RECEIVER PORTION

(75) Inventors: Byron B. Taylor, Tucson, AZ (US); Thomas J. Wetherell, Colorado Springs, CO (US); Brian S. Scott, Vail, AZ (US); Ronald L. Roncone, Vail, AZ (US)

(73) Assignee: Raytheon Company, Waltham, MA (US)

( * ) Notice: Subject to any disclaimer, the term of this patent is extended or adjusted under 35 U.S.C. 154(b) by 141 days.

(21) Appl. No.: 12/478,005

(22) Filed: Jun. 4, 2009

(65) Prior Publication Data

US 2012/0062410 A1 Mar. 15, 2012

(51) Int. Cl.
*G01C 3/08* (2006.01)

(52) U.S. Cl. ..... 356/4.01; 356/3.01; 356/3.1; 356/4.1

(58) Field of Classification Search ..... 356/3.01–3.15, 356/4.01–4.1, 5.01–5.15, 6–22, 28, 28.5
See application file for complete search history.

(56) References Cited

U.S. PATENT DOCUMENTS

| | | | | |
|---|---|---|---|---|
| 4,240,596 | A * | 12/1980 | Winderman et al. | 244/3.16 |
| 4,717,263 | A | 1/1988 | Phillips | |
| 5,973,649 | A | 10/1999 | Andressen | |
| 6,268,822 | B1 | 7/2001 | Sanders et al. | |
| 6,606,066 | B1 | 8/2003 | Fawcett et al. | |
| 7,183,966 | B1 | 2/2007 | Schramek et al. | |
| 7,185,845 | B1 | 3/2007 | Hartman et al. | |
| 2005/0093757 | A1 | 5/2005 | Kiernan, Jr. et al. | |
| 2007/0008514 | A1 * | 1/2007 | Krasutsky | 356/4.01 |

FOREIGN PATENT DOCUMENTS

| | | | |
|---|---|---|---|
| GB | 2280201 | A | 1/1995 |
| GB | 2446052 | A | 7/2008 |
| WO | 2007078324 | A2 | 7/2007 |

OTHER PUBLICATIONS

International Search Report and Written Opinion from corresponding International Application No. PCT/US10/26471.
Written Opinion from corresponding International Application No. PCT/US10/26471.

* cited by examiner

*Primary Examiner* — Luke Ratcliffe
(74) *Attorney, Agent, or Firm* — Renner, Otto, Boisselle & Sklar, LLP

(57) ABSTRACT

A seeker/receiver system for a moving body, such as for guiding the moving body to a target, includes an optics/receiver portion that tilts as a unit relative to other parts of the moving body. The optics/receiver portion includes a window which may be used to enclose and protect one or both of a pair of receivers or detectors, such as a laser energy detector or receiver, and an infrared energy detector or receiver. By moving the window and the receivers as a unit a set positional relationship is maintained between all of the elements of the optics/receiver portion. This simplifies the optics by obviating the need for all aspects of the window to present the same properties to energy detectors that tilt relative to it. The optics/receiver portion may be tilted using a tilt mechanism such as a gimbal.

20 Claims, 9 Drawing Sheets

MULTI-BAND SEEKER WITH TILTABLE OPTICAL/RECEIVER PORTION

BACKGROUND OF THE INVENTION

1. Field of the Invention

The application is in the field for seekers in moving bodies for target acquisition and for guidance of the bodies.

2. Description of the Related Art

Seekers have long been used in munitions such as missiles in order to acquire targets, and for other guidance procedures. Multiple mode seekers, which acquire data using multiple wavelengths of energy, have also been used. Such sensors respond to both infrared and microwave radiation, for instance. Such seekers have been generally located at the nose of aircraft or missiles, in order to obtain an unobstructed field of view. Seekers have generally been placed within a window at the nose of the vehicle.

Improvements over prior seekers would in general be desirable.

SUMMARY OF THE INVENTION

Unlike prior seekers, which have utilized a fixed window with detectors and optics within the window able to tilt relative to the window, seekers are described herein in which the forward window, detectors, and optics all tilt as a unit. The prior fixed-window systems limit the practical window shapes, due to a need to present substantially similar properties to the detectors and optics regardless of angle of tilt. This not only limits available shapes, but as a practical matter requires the fixed window to be made of the same material throughout. Further, the present fixed-window configurations limit the available locations for placement of the detectors and optics, in order to obtain performance that was largely invariant to tilting of the detectors and optics.

According to an aspect of the invention, a seeker/receiver has an optics/receiver portion that tilts as a unit. The optics/receiver portion includes an optical window that is part of an outside surface of the moving body that the seeker/receiver is part of.

According to another aspect of the invention, an optical window for a seeker has a shape that is not a portion of a sphere. The shape may be flat, an ellipsoid, a segmented shape, or other non-spherical shapes.

According to yet another aspect of the invention, an optical window for a multiple frequency seeker has different materials and/or different optical properties in different portions.

According to a further aspect of the invention, a multimode seeker for a moving body includes: a laser energy receiver for detecting incoming laser energy; an imaging infrared (IIR) receiver for detecting incoming infrared energy; an optical window through which at least the infrared energy passes before reaching the IIR receiver; and a tilt mechanism for tilting the laser energy receiver, the IIR receiver, and the optical window, as a unit, relative to other parts of the moving body.

According to a still further aspect of the invention, a multimode seeker for a moving body includes: a pair of receivers that preferentially detect different wavelengths of energy; an optical window through which incoming energy passes from outside of the moving body to at least one of the receivers; and a tilt mechanism for tilting the receivers and the window, as a unit, relative to other parts of the moving body.

According to another aspect of the invention, a method of operating a seeker of a moving body includes: using a tilt mechanism of the seeker to tilt as a unit a portion of the seeker, relative to the moving body, during flight of the moving body. The portion includes: a window at an external surface of the moving body; a detector for detecting incoming energy that passes through the window from outside the moving body; and optics that directs and focuses the incoming energy to the detector.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

In the annexed drawings, which are not necessarily to scale.

DETAILED DESCRIPTION

A seeker/receiver system for a moving body, such as for guiding the moving body to a target, includes an optics/receiver portion that tilts as a unit relative to other parts of the moving body. The optics/receiver portion includes a window which may be used to enclose and protect one or both of a pair of receivers or detectors, such as a laser energy detector or receiver, and an infrared energy detector or receiver. By moving the window and the receivers as a unit a set positional relationship is maintained between all of the elements of the optics/receiver portion. This simplifies the optics by obviating the need for all aspects of the window to present the same properties to energy detectors that tilt relative to it. This allows for different shapes for the window, for different materials to be used for different parts of window (for example materials selected for desirable optical properties in conjunction with the different energy detectors), and/or for placement of one of the detectors outside of the window for another of the detectors. The optics/receiver portion may be tilted using a tilt mechanism such as a gimbal.

Figure 1:
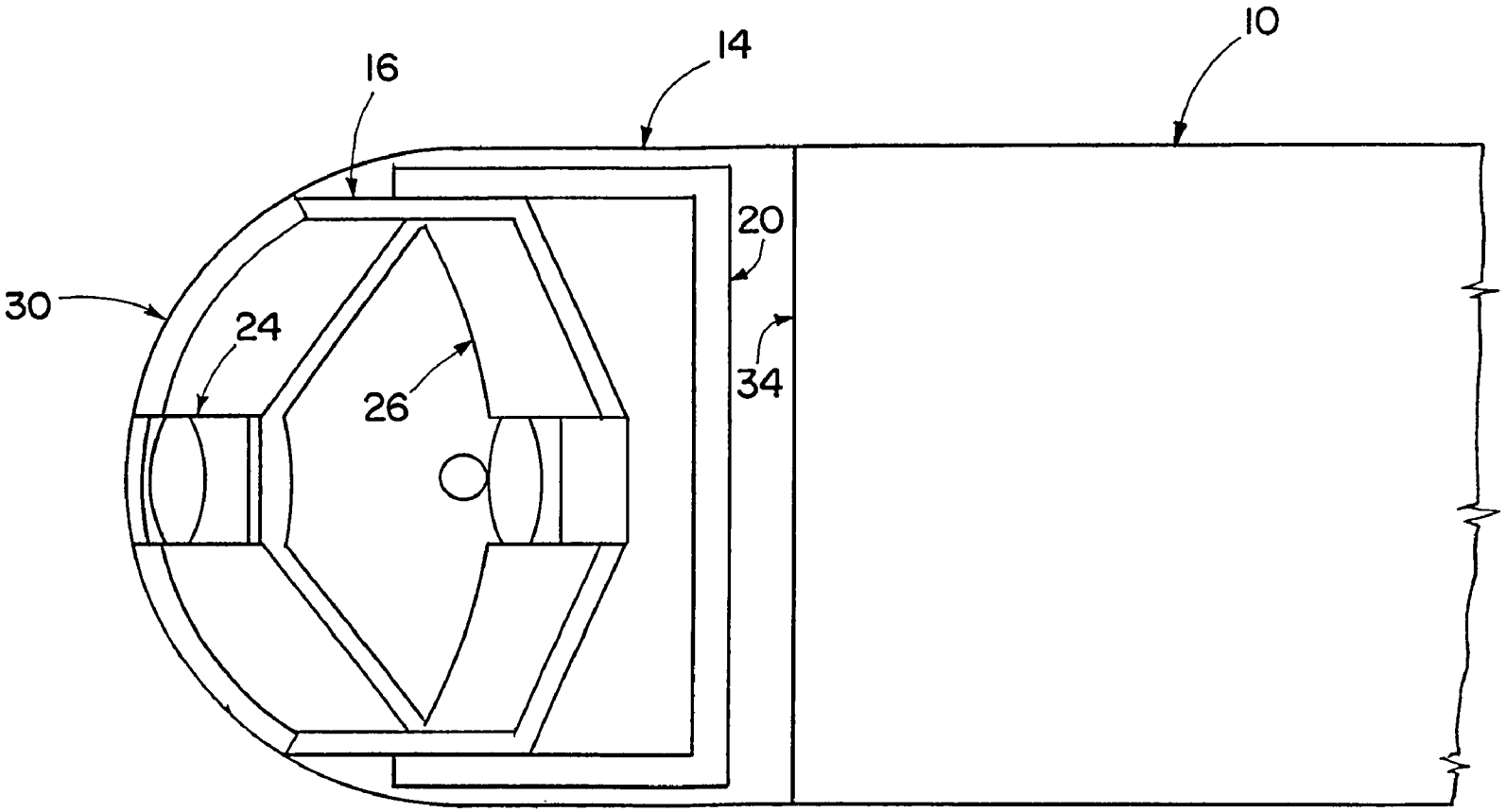
FIG. 1 is a cross-sectional view of a moving body with a seeker/receiver system in accordance with an embodiment of the invention.

Referring initially to FIG. 1, a portion of a moving body 10 is shown. The moving body 10 may be any of a variety of targeted air vehicles, such as a missile, a projectile, or other type of munition. The moving body 10 has a targeting system such as a seeker/receiver 14 for acquiring and tracking targets. The seeker/receiver 14 works in general by mostly passively receiving signals bouncing off of a target. The seeker/receiver 14 includes an optics /receiver portion 16, and a tilt system 20. The optics/receiver portion 16 includes a semi-active laser (SAL) receiver or subsystem 24 and an imaging infrared (IIR) receiver or subsystem 26. The SAL receiver may be used for detecting energy having a 1.064 μm (micron) wavelength (or energy of another suitable wavelength), to give one example frequency. The IIR receiver 26 may be configured for detecting energy having an 8-13 micron wavelength energy (or energy of another suitable wavelength).

The optics/receiver portion 16 also includes an optical window 30 through which one or both of the SAL receiver 24 and the IIR receiver 26 receive signals. The tilt system 20 is used to tilt the optics/receiver portion 16, as a unit, relative to other parts of a fuselage 34 of the moving body 10. A usual configuration is for the seeker/receiver 14 to be placed at the front of the moving body 10. This is the location where the seeker/receiver is able to get the best view of potential targets, and is thus able to be most effective.

The ability of the optics/receiver portion 16 to tilt or otherwise move as a unit allows for improvements in configuration of the seeker/receiver 14. A wider range of configurations for the receivers 24 and 26 relative to the window 30 may be utilized. Additional other variations in configuration of the optics/receiver portion 16 may be made as a result of the portion 16 being able to tilt as a unit. Some of these variations are described below with regard to certain exemplary embodiments. However it will be appreciated that additional variations are possible.

Figure 2:
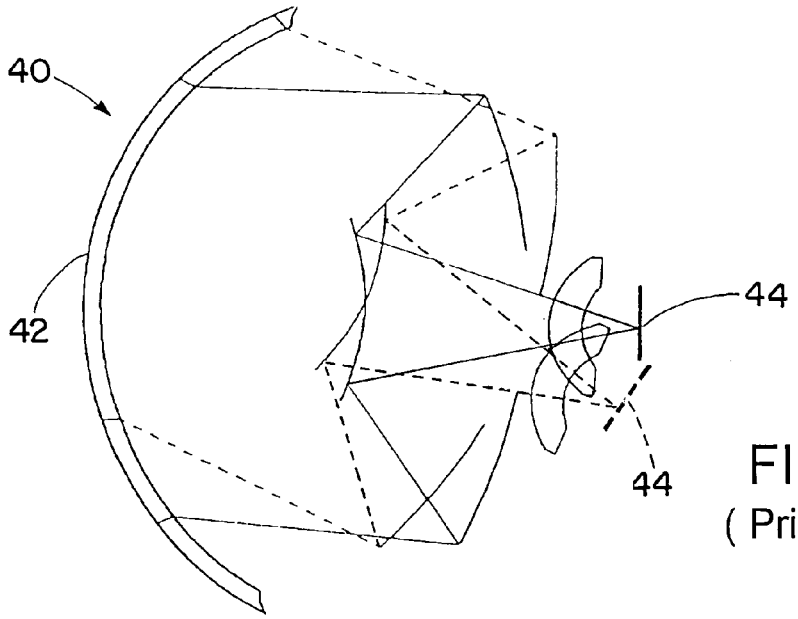
FIG. 2 ( Prior Art )
FIG. 2 is a schematic diagram of a prior art seeker/receiver system.
Figure 3:
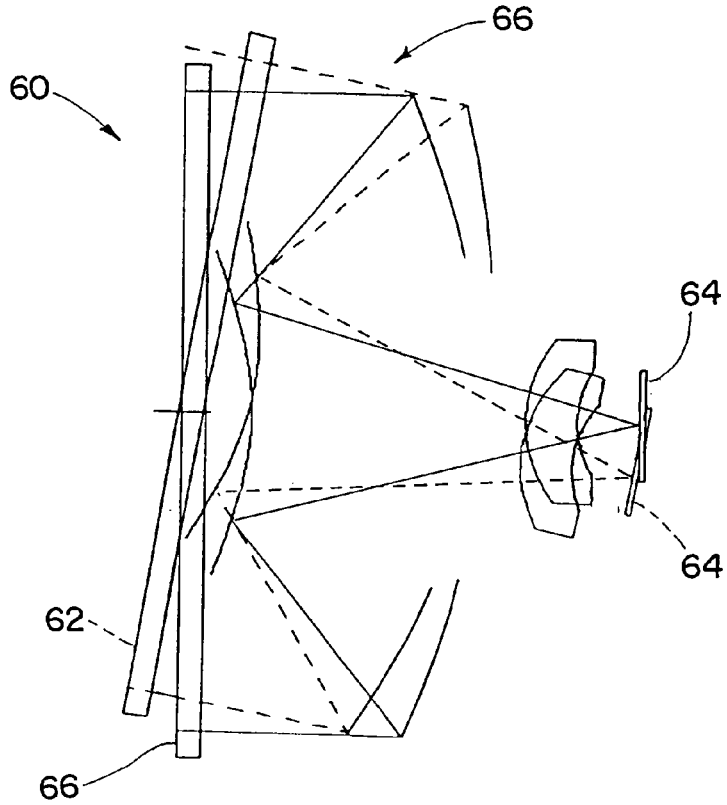
FIG. 3 is a schematic diagram of parts of a seeker/receiver system in accordance with an embodiment of the invention.

FIGS. 2 and 3 illustrate a difference between a prior art seeker/receiver and a system such as that shown in FIG. 1. The prior art seeker/receiver 40 in FIG. 2 has a fixed window 42, with an IIR detector 44 (and its associated optics) tiltable within the fixed window 42. Two positions of the IIR detector 44 are shown in FIG. 2—one in solid lines, and the other in broken lines. This configuration results in many limitations: 1) the window 42 has to be large enough to cover a full field of regard for the seeker/receiver 40; 2) the window 42 must be shaped so that it is able to provide substantially similar optical properties throughout the field of regard, no matter what the tilt of the IIR detector 44 is; and 3) there is a limit as to the permissible location of the IIR detector 44 so that it is a focal point or other suitable location within the fixed window 42.

In addition, further difficulties present themselves for seeker/receivers that also include a SAL detector. In such systems the SAL detector needs to tilt as well, necessitating its placement inside the fixed window 42. The SAL detector thus must image through the same fixed window 42 used by the IIR detector 44. This may result in the material for the fixed window 42 being a compromise between a material optimized for use with the SAL detector, or a material optimized for use with the IIR detector 44. Or a more expensive material, suitable for both detectors, may have to be used for the entire fixed window 42. Further, the position of the SAL detector relative to the fixed window 42 may be seriously constrained by the need to have substantially constant optical characteristics for the SAL detector as the SAL detector is tilted or rotated.

FIG. 3 schematically shows a seeker/receiver 60 that may be provided to overcome these difficulties. The seeker/receiver 60 has a window 62 that tilts or rotates along with an IIR detector 64 (and other optics associated with IIR detector). The window 62 and the IIR detector 64 together constitute an optics/receiver portion 66 of the seeker/receiver 60, with the optics/receiver portion 66 tilting as a unit. Two positions of the optics/receiver portion 66 are shown in FIG. 3—one in solid lines, and the other in broken lines. By having the optics/receiver portion 66 tilt as a unit there is no need for the window 62 to have a shape that can provide substantially similar optical properties for a range of relative positions or orientations between the IIR detector 64 and the window 62. This is because the seeker/receiver 60 has a fixed relative position/orientation between the window 62 and the IIR detector 64, with the window 62 and the IIR detector 64 only tilting as a combined unit. This configuration allows different shapes to be utilized for the window 62, such as the flat shape shown in FIG. 3. In addition the window 62 may be faceted or segmented, with different facets or segments providing different optical characteristics.

A further advantage to tilting the optics/receiver portion 66 as a unit is that correction may be made at the IIR detector 64 for variations in optical properties in different parts of the window 62. Since there is a fixed spatial relationship between the IIR detector 64 and the window 62 only one set of corrections or adjustments would be necessary.

A still further advantage is that having a movable window may enable use of smaller window. This may result in a less expensive and lighter seeker.

Other advantages may be realized when the seeker/receiver 60 is a multi-frequency seeker (also referred to as a multi-mode seeker), for example including a SAL detector. The SAL detector would be a part of the optics/receiver portion 66, tiltable along with the window 62 and the IIR detector 64. The SAL detector may be placed in any of a variety of locations, inside the window 62, outside of the window 62, or even in an opening in the window 62, for example in an opening at the center of the window 62, along a central axis of the seeker/receiver 60. The window 62 may have different portions optimized for the different wavelengths used by the SAL detector and the IIR detector 64, for example utilizing different materials, and/or materials with different treatments to obtain different properties. One or both of the materials may be a relatively low cost material.

Figure 4:
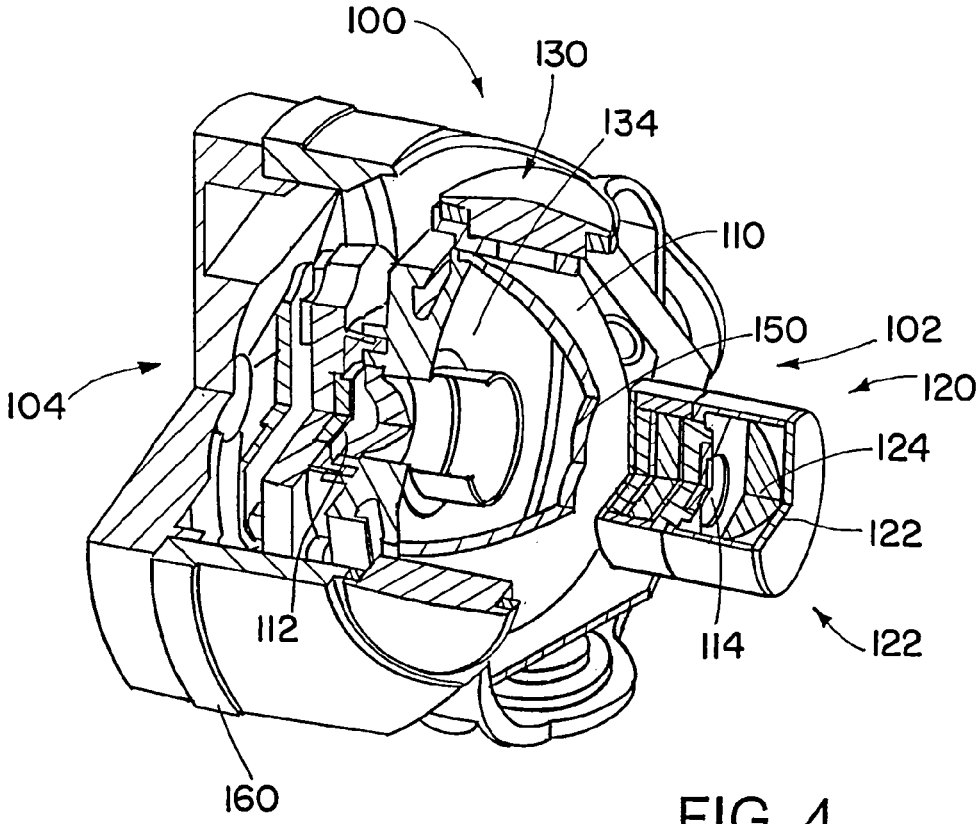
FIG. 4 is an oblique, partial cutaway view of a seeker/receiver in accordance with another embodiment of the present invention.

FIG. 4 shows one embodiment, a seeker/receiver 100 that with has an optics/receiver portion 102 that is tiltable by a tilt system or mechanism 104. The optics/receiver portion 102 includes a window 110, an IIR detector 112, and a SAL detector 114.

The SAL detector 114 is mounted to an outside surface of the window 110. The SAL detector 114 is part of a SAL subsystem or receiver 120 that also includes a SAL filter 122 and a SAL lens 124. A suitable SAL detector may be obtained from PerkinElmer, Inc., of Freemont, Calif., USA. Energy is focused on the SAL detector 114 by the lens 124, after first passing though the SAL filter 122. The SAL filter 122 insures that most of the solar radiation does not reach the SAL detector 114. The lens 124 may be made of a material, such as zinc sulfide or zinc selenide. More broadly, the lens 124 may be made of any material that substantially passes the 1.064 μm radiation (or other radiation), another example of a material being polyetherimide.

The window 110 is shown having a dome shape, for example a portion or section of a sphere. Alternatively the window 110 may have a wide variety of other alternative shapes, some of which are discussed below in connection with other embodiments. The window 110 may be hot isostatic pressed (HIP) zinc sulfide, such as a material sold under the trademark CLEARTRAN. Such HIP-treated zinc sulfide is a multispectral chemical vapor deposited ZnS. The HIP treatment removes water, improves transmission in the near IR and visible spectrum region, by altering the chemical and crystalline structure of the ZnS, among other improvements in properties.

The IIR detector 112 is part of an IIR subsystem receiver 130. The IIR subsystem 130 also includes an IIR mirror 134, a central IIR reflector (which also could be referred to as a beam splitter or a dichroic mirror), and an IIR lens. Incoming IIR energy passes through outer portions of the dome window 110 and is reflected off of the IIR mirror 134 toward the central reflector. At the central reflector the incoming IIR energy is reflected again, toward the IIR detector 112. The IIR lens focuses this energy onto the IIR detector 112.

The mirror 134 may be made of aluminum or another suitable material or coating for reflecting IR energy. The central reflector may be made of $SiO_2$ or another suitable material. The lens may be made of germanium or another suitable material.

Parts of the optics for the IIR subsystem 130 may be also be used by a microwave antenna 150 that transmits millimeter wave (MMW) energy. MMW energy transmitted by the antenna 150 passes through the central reflector and is reflected by the mirror 134. The reflected MMW energy passes out through the window 110, out of the seeker/receiver 100.

Figure 5:
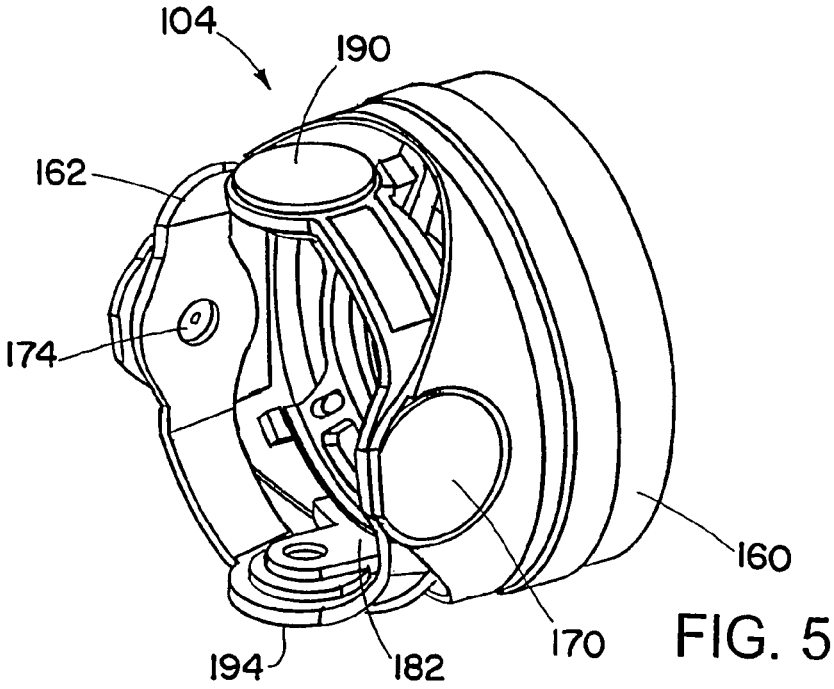
FIG. 5 is an oblique view showing the tilt mechanism of the seeker/receiver of FIG. 4.
Figure 6:
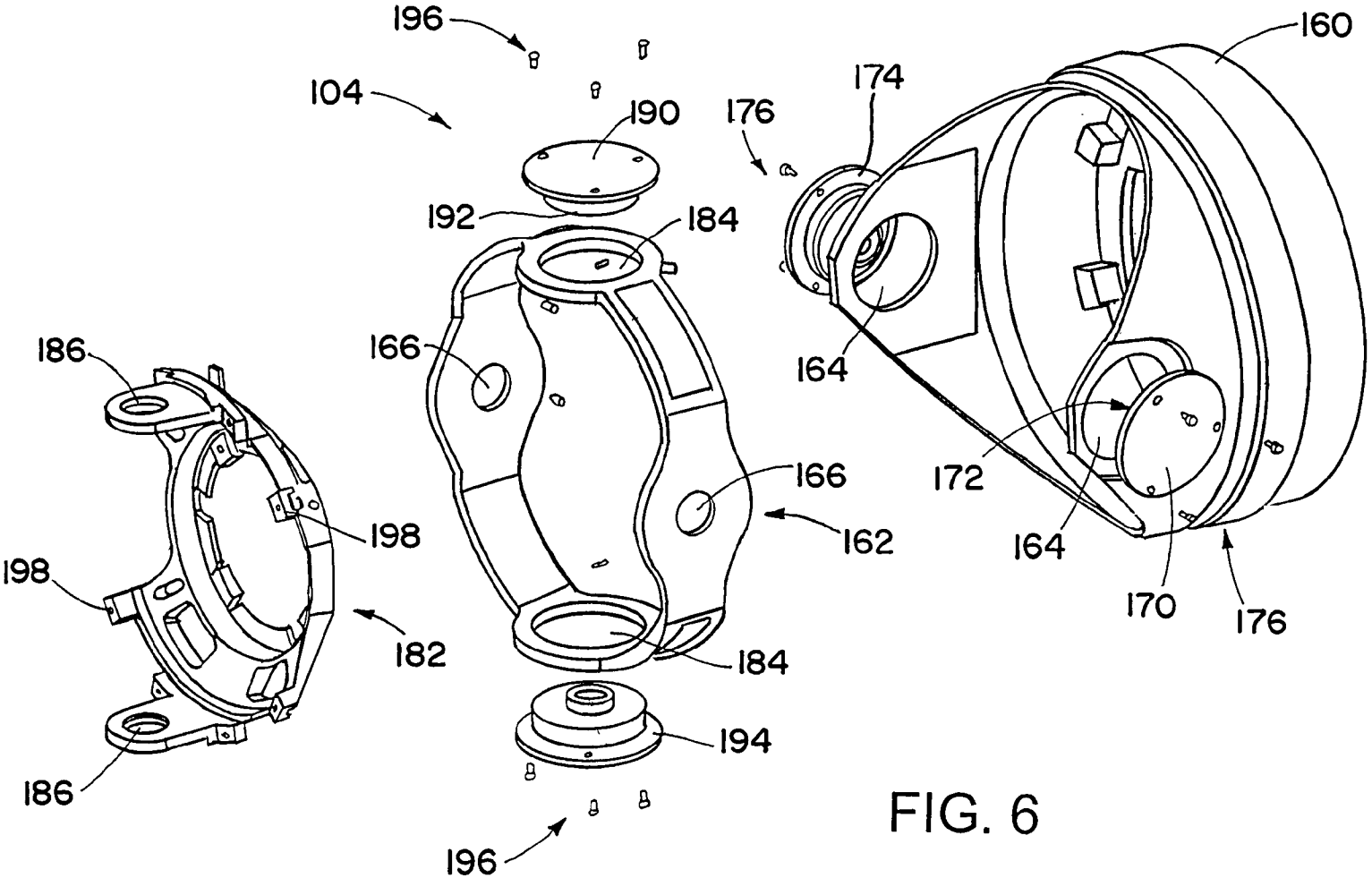
FIG. 6 is an exploded view of the tilt mechanism of FIG. 5.

With reference now in addition to FIGS. 5 and 6, details will be given regarding the parts and operation of the tilt system or mechanism 104. The tilt mechanism 104 includes a base or pedestal 160 that is fixed to the fuselage of the munition or other moving body. An outer gimbal ring 162 is pivotally coupled to the base or pedestal 160. The base 160 and the outer gimbal ring 162 are coupled together at respective sets of holes 164 and 166 in the two parts 160 and 162. An elevation motor 170 is used to tilt the outer gimbal ring 162 relative to the base 160 (changing the elevation of the outer gimbal ring 162). The elevation motor 170 is inserted through one of the holes 164 of the base 160, and has a shaft 172 that engages a corresponding hole 166 in the outer gimbal ring 162. On the opposite side of the base 160 and the outer gimbal ring 162, an elevation position sensor 174 provides feedback on the position (orientation) of the outer gimbal ring 162 relative to that of the base 160. The elevation motor 170 and the elevation position sensor 174 are attached to opposite sides of the base 160, for example by use of screws 176. The elevation motor 170 may be controlled by a suitable controller for the seeker/receiver 100 (FIG. 4), which may use data from the elevation position sensor 174 as an input.

An inner gimbal ring 182 is pivotally mounted to the outer gimbal ring 162, to allow the inner gimbal ring 182 to tilt relative to the outer gimbal ring 162. The gimbal rings 162 and 182 are coupled together at respective sets of holes 184 and 186. An azimuth motor 190 is attached to the outer gimbal ring 162. A shaft 192 of the motor 190 protrudes through one of the holes 184, and is coupled to the inner gimbal ring 182 at a corresponding one of the holes 186. The azimuth motor 190 is used to tilt or pivot the inner gimbal ring 182 relative to the outer gimbal ring 162. An azimuth position sensor 194 is coupled to the opposite end of the gimbal rings 162 and 182. The azimuth position sensor 194 is used to measure the azimuth position of the inner gimbal ring 182. The azimuth motor 190 may be controlled in a manner similar to that of the elevation motor 170. The azimuth position sensor 194 may have its data utilized in a manner similar to that of the elevation position sensor 174. The azimuth motor 190 and the azimuth position sensor 194 are attached to opposite sides of the outer gimbal ring 162, such as by use of screws 196.

The optics/receiver portion 102 (FIG. 4) is attached to the inner gimbal ring 182 at a series of brackets 198 along the inner gimbal ring 182. Threaded fasteners (not shown) may be used to couple the optics/receiver portion to the inner gimbal ring 182.

The seeker 100 is thus tiltable in a pair of orthogonal directions, in elevation and azimuth. It will be appreciated that configuration shown in FIGS. 4-6 is only one of many possible configurations for a seeker/receiver. Many variations are possible including for example different shapes and/or control mechanisms for the gimbal rings 162 and 182.

Figure 7:
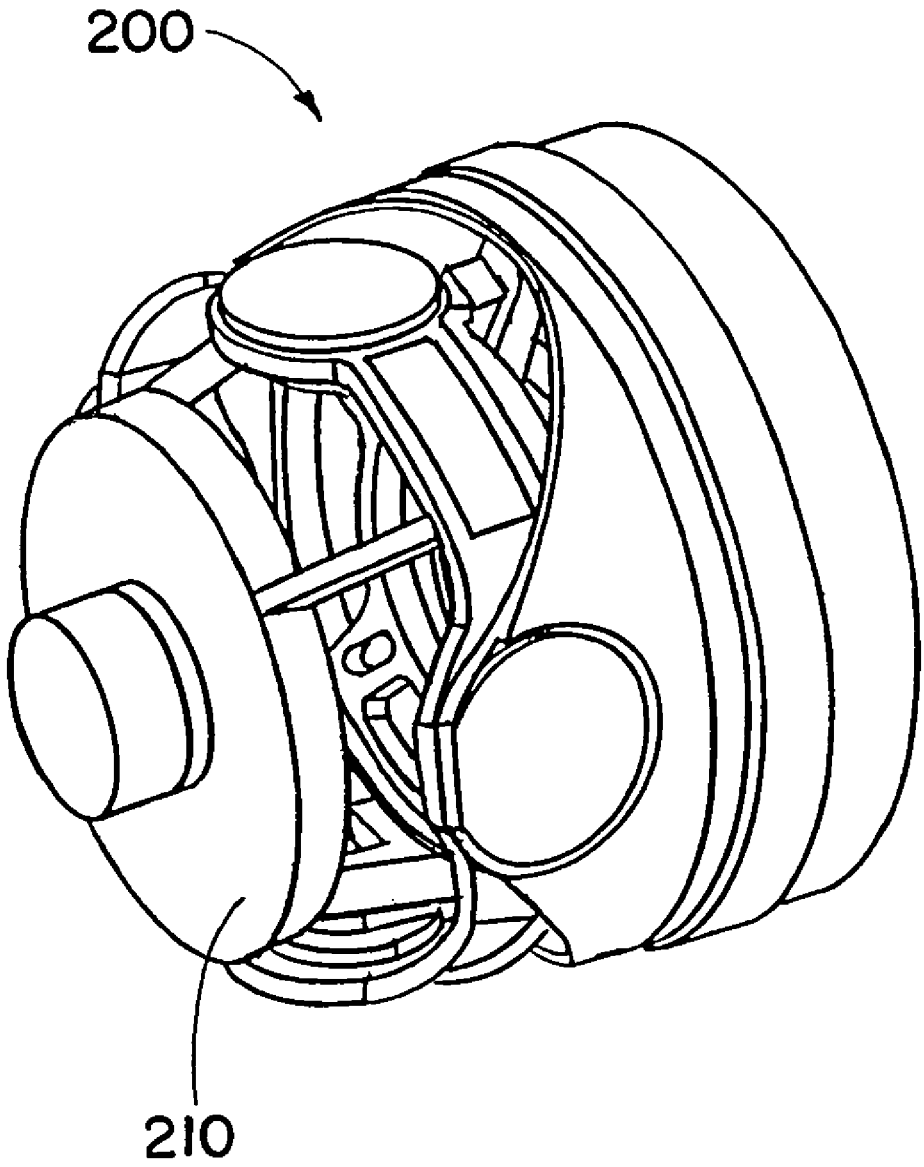
FIG. 7 is an oblique view of a seeker/receiver system having a substantially flat window, in accordance with yet another embodiment of the present invention.

FIG. 7 shows an alternative embodiment seeker/receiver 200 that differs from the seeker/receiver 100 (FIG. 4) in that the seeker/receiver 100 has a flat optical window 210, as opposed to the dome-shaped optical window 110 (FIG. 4) of the seeker/receiver 100.

Figure 8:
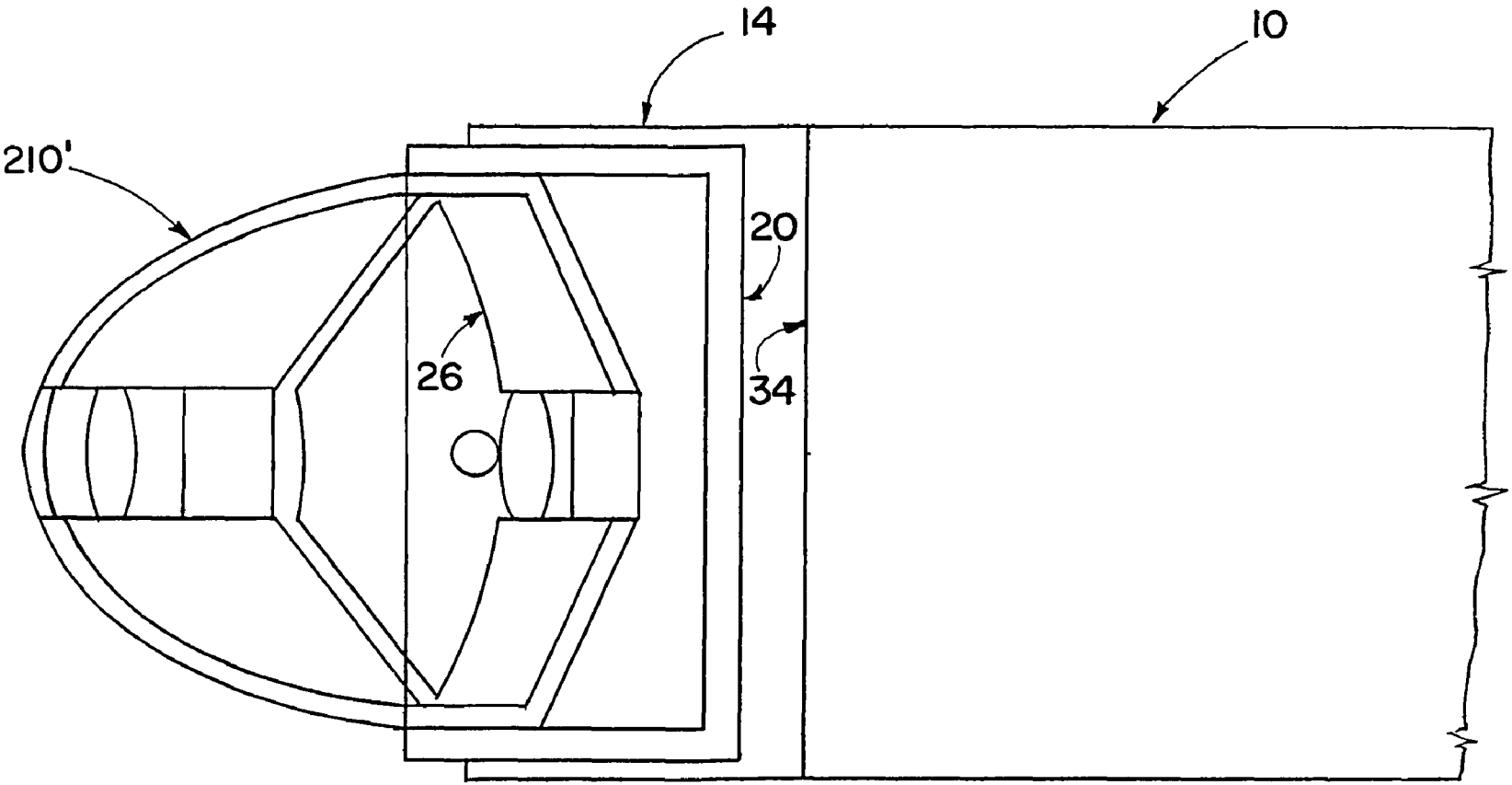
FIG. 8 is a cross-sectional view of an elongate-shape window usable as part of a seeker/receiver system, in accordance with still another embodiment of the present invention.
Figure 9:
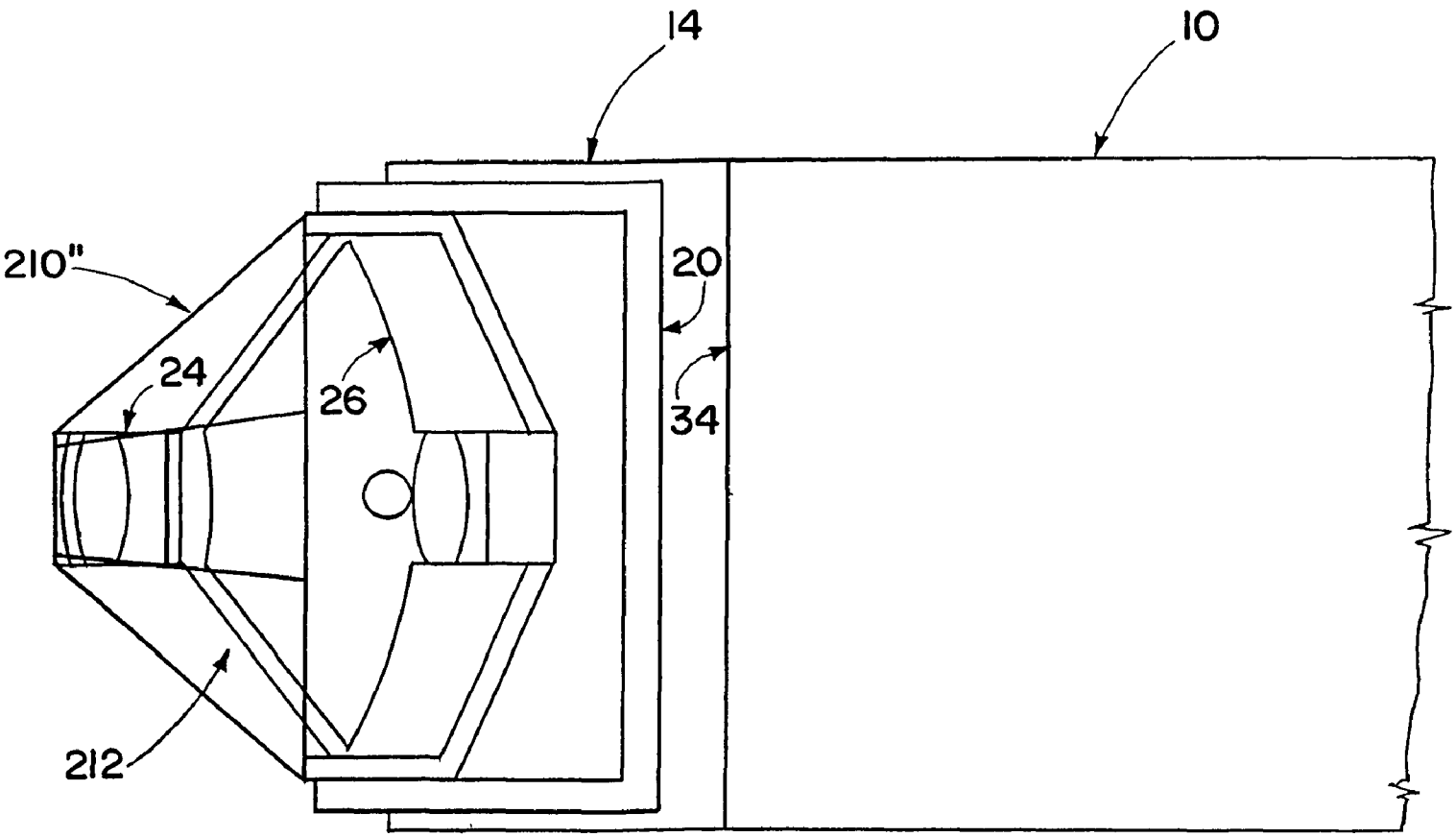
FIG. 9 is a cross-sectional view of a segmented window usable as part of a seeker/receiver system, in accordance with still another embodiment of the present invention.

FIGS. 8 and 9 show other possible shapes of optical windows for use as part of seekers/receivers described herein. The optical window 210' shown in FIG. 8 has an elongated dome shape, such as that of a prolate ellipsoid.

The optical window 210" shown in FIG. 9 has a segmented shape, consisting of a plurality of segments 212. The segments 212 may have different thicknesses and/or different orientations from adjoining segments, leading them to have different optical properties. The segments 212 may be any of a variety of suitable shapes, and the window 210" formed from the segments 212 may have any of variety of suitable overall shapes, such as a variety of generally flat or curved shapes. The window 210" may be a monolithic unitary structure, or may include a number of pieces joined together.

Figure 10:
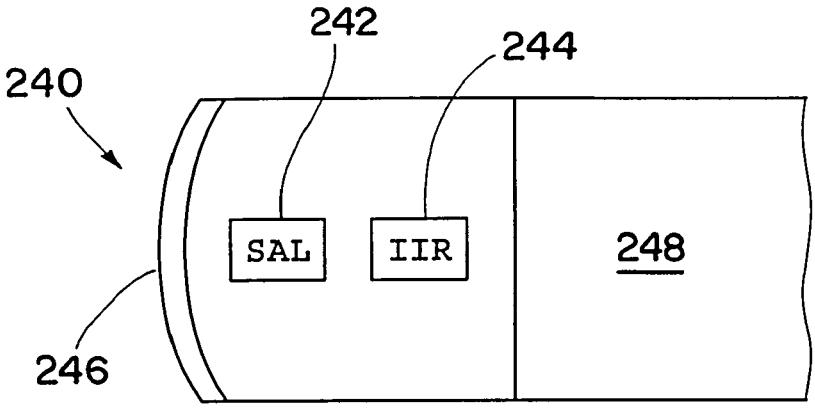
FIG. 10 is a schematic view showing a first general arrangement of parts a seeker/receiver system, in accordance with a further embodiment of the invention.
Figure 11:
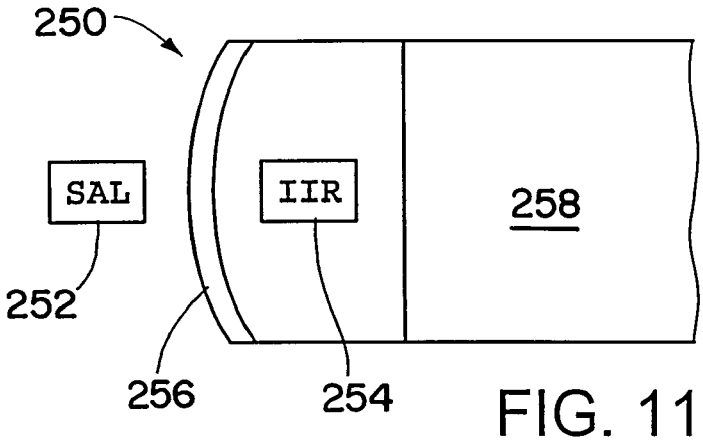
FIG. 11 is a schematic view showing a second general arrangement of parts a seeker/receiver system, in accordance with a still further embodiment of the invention.
Figure 12:
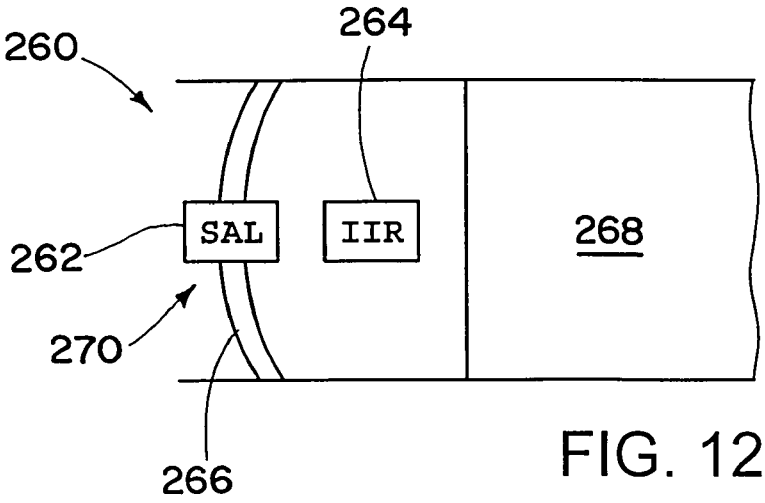
FIG. 12 is a schematic view showing a third general arrangement of parts a seeker/receiver system, in accordance with another embodiment of the invention.

FIGS. 10-12 illustrate three possible relative locations of a window, a SAL subsystem, and an IIR subsystem. In the seeker/receiver 240 shown in FIG. 10, both a SAL subsystem 242 and an IIR subsystem 244 are between a window 246 and a fuselage 248. The window 246 may be a single-material window, or alternatively may have different portions, perhaps utilizing different materials, for use by the SAL subsystem 242 and the IIR subsystem 244. In the seeker/receiver 250 shown in FIG. 11, a SAL subsystem 252 is in front of (outside) a window 256, while an IIR subsystem 254 is between the window 256 and a fuselage 258. In the seeker/receiver 260 shown in FIG. 12, a SAL subsystem 262 is located within an opening 270 in a window 266. An IIR subsystem 264 is between the window 266 and a fuselage 268.

It will be appreciated that any of the configurations shown in FIGS. 10-12 may be combined with appropriate features of other embodiments described herein. More generally, features of the various embodiments described herein may be combined with one another as appropriate.

Figure 13:
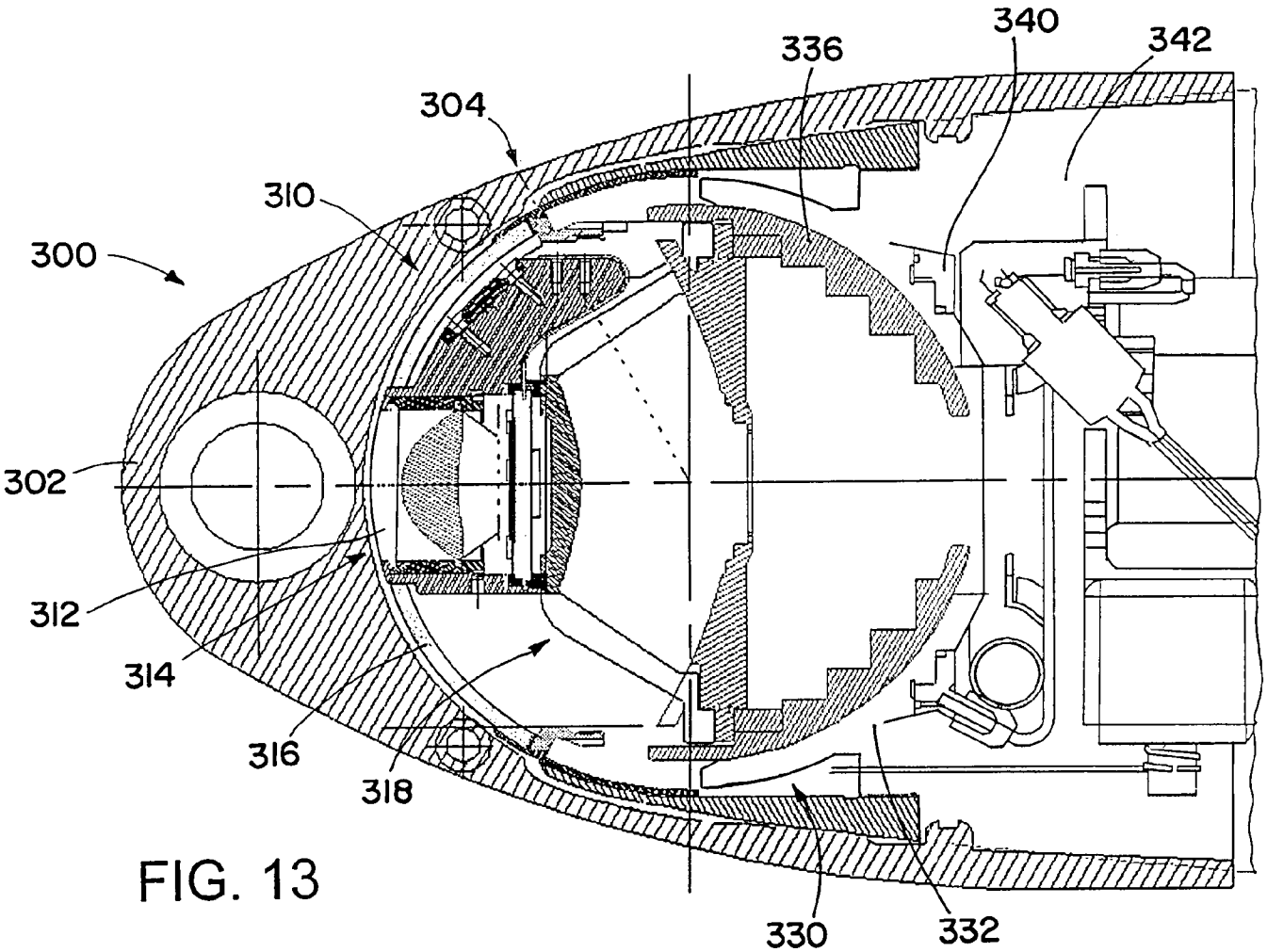
FIG. 13 is sectional view of a seeker/receiver system in accordance with yet another embodiment of the invention.

FIG. 13 shows an alternative embodiment seeker/receiver 300. The seeker/receiver 300 is shown with a protective cover 302 in place. The cover 302 protects the seeker/receiver 300 from damage, and provides a more aerodynamic shape. The cover 302 is removed prior to operation of the seeker/receiver 300, such as by detonation of a squib in order to blow off the cover 302.

An optics/receiver portion 304 of the seeker/receiver 300 is similar in many respects to those of other embodiments described herein. Many of the parts, and functions, are similar to that of corresponding parts of the seeker/receiver 100 (FIG. 4). One difference is that the window 310 of the seeker/receiver 300 is a multipart window. A small central window or window portion 312 is used for a SAL detector subsystem 314. The central window portion 312 is surrounded by a larger window or window portion 316 for use by an IIR subsystem 318. The window portions 312 and 316 may together make for a substantially smooth surface, with substantially no transition between the window portions 312 and 316 in the form of a shape change. The windows 312 may include different respective materials, with each material selected for suitability in use with its corresponding subsystem. For example, the central window portion 312 may be made of HIP-treated zinc sulfide or common glass, such as BK7 glass, or even a suitable plastic. The surrounding window portion 316 may be made of standard or untreated zinc sulfide. Standard or untreated zinc sulfide is defined herein as zinc sulfide that has not undergone a HIP treatment. The surrounding window material alternatively could be treated zinc sulfide, or another material such as treated zinc selenide. It will be appreciated that standard zinc sulfide is less expensive than treated zinc sulfide.

A tilt mechanism 330 of the seeker/receiver 300 is a spherical gas bearing 332 for precision rotational positioning of an optics/receiver portion 332 of the seeker/receiver 300. The optics/receiver portion 332 includes a back bracket 336 having a spherical outer shape. Motors rotate the bracket 336, and thus the rest of the optics/receiver portion 332 as well, within a socket defined by adjoining structure 340 of a fuselage 342. Thus the tilt mechanism 330 is a ball-and-socket mechanism, a ball-and-socket gimbal that uses motors to position angle of the optics/receiver portion 332 relative to the fuselage 342.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A multimode seeker for a moving body, the seeker comprising:

a laser energy receiver for detecting incoming laser energy;

an imaging infrared (IIR) receiver for detecting incoming infrared energy at a different wavelength from the incoming laser energy;

an optical window through which at least the infrared energy passes before reaching the IIR receiver; and a tilt mechanism for tilting the laser energy receiver, the IIR receiver, and the optical window, as a unit, relative to other parts of the moving body;

wherein the laser energy receiver is mechanically coupled to the window; and wherein at least part of the laser energy receiver is not between the window and a fuselage of the body, with the at least part of the laser energy receiver not being inside the window.

2. The multimode seeker of claim 1, wherein the optical window has multiple parts that preferentially pass different energy frequencies.

3. The multimode seeker of claim 2, wherein a first part of the optical window is operatively coupled to the laser energy receiver for passing energy therethrough to be received by the laser energy receiver; and wherein a second part of the optical window is operatively coupled to the infrared energy receiver for passing energy therethrough to be received by the IIR receiver.

4. The multimode seeker of claim 3, wherein the parts of the window are made of different materials.

5. The multimode seeker of claim 4, wherein one of the materials is standard zinc sulfide.

6. The multimode seeker of claim 3, further comprising a microwave antenna that transmits millimeter wave (MMW) energy that passes through the second part of the optical window.

7. The multimode seeker of claim 1, wherein the laser energy receiver is mechanically coupled to an outside surface of the window, in front of the window.

8. The multimode seeker of claim 1, wherein the laser energy receiver passes through an opening around a central axis of the window.

9. The multimode seeker of claim 1, wherein the window has a substantially spherical shape.

10. The multimode seeker of claim 1, wherein the window is substantially flat.

11. The multimode seeker of claim 1, wherein the window has an ellipsoid shape.

12. The multimode seeker of claim 1, wherein at least part of the window is made of standard zinc sulfide.

13. The multimode seeker of claim 1, wherein at least part of the window is made of standard zinc selenide.

14. The multimode seeker of claim 1, wherein the tilt mechanism includes a gimbal that the laser energy receiver, the IIR receiver, and the optical window are all mechanically coupled to.

15. The multimode seeker of claim 1, wherein the tilt mechanism tilts in at least two orthogonal directions.

16. A multimode seeker for a moving body, the seeker comprising:

a laser energy receiver for detecting incoming laser energy;

an imaging infrared (IIR) receiver for detecting incoming infrared energy at a different wavelength from the incoming laser energy;

an optical window through which at least the infrared energy passes before reaching the IIR receiver; and a tilt mechanism for tilting the laser energy receiver, the IIR receiver, and the optical window, as a unit, relative to other parts of the moving body;

wherein the window is substantially flat.

17. The multimode seeker of claim 16, wherein the optical window has multiple parts that preferentially pass different energy frequencies.

18. The multimode seeker of claim 17, wherein a first part of the optical window is operatively coupled to the laser energy receiver for passing energy therethrough to be received by the laser energy receiver; and wherein a second part of the optical window is operatively coupled to the infrared energy receiver for passing energy therethrough to be received by the IIR receiver.

19. The multimode seeker of claim 18, wherein the parts of the window are made of different materials.

20. The multimode seeker of claim 19, wherein one of the materials is standard zinc sulfide.

* * * * *